United States Patent [19]

Ivanov

[11] Patent Number: 4,491,081

[45] Date of Patent: Jan. 1, 1985

[54] METHOD FOR ASSEMBLING A COMPLETE MODULE OF MULTIDECK SHIP HULL

[76] Inventor: Jury P. Ivanov, Grazhdansky prospekt, 92/2, kv.1, Leningrad, U.S.S.R.

[21] Appl. No.: 346,054

[22] PCT Filed: May 29, 1981

[86] PCT No.: PCT/SU81/00049

§ 371 Date: Jan. 22, 1982

§ 102(e) Date: Jan. 22, 1982

[87] PCT Pub. No.: WO81/03473

PCT Pub. Date: Dec. 10, 1981

[30] Foreign Application Priority Data

Jun. 4, 1980 [SU] U.S.S.R. ..... 2926007

[51] Int. Cl.[3] ..... B63B 3/02

[52] U.S. Cl. ..... 114/77 R; 114/65 R; 29/429

[58] Field of Search ..... 114/65 R, 77 R, 56, 114/77 A; 29/429; 52/123.1, 745

[56] References Cited

U.S. PATENT DOCUMENTS

| | | | |
|---|---|---|---|
| 1,418,510 | 6/1922 | Alexander | 52/123.1 |
| 1,559,807 | 11/1925 | Thaden | 29/429 |
| 3,253,565 | 5/1966 | Mangone | 114/65 R |
| 3,429,288 | 2/1969 | Suit | 114/65 R |

*Primary Examiner*—Sherman D. Basinger
*Assistant Examiner*—Jesus D. Sotelo
*Attorney, Agent, or Firm*—Lilling & Greenspan

[57] ABSTRACT

The method for assembling a complete module of a multideck ship in the assembly location an upper deck section, then lifting it to a height exceeding the height of a first 'tween deck, whereupon the 'tween deck is introduced under the upper deck section and they are joined together.

This done, the assembled portion is again lifted to a height exceeding the height of a second 'tween deck, the second 'tween deck is introduced under the assembled portion of the module and joined thereto. Following the indicated procedure the remaining 'tween deck sections are installed and joined in succession to the already assembled portion.

5 Claims, 13 Drawing Figures

METHOD FOR ASSEMBLING A COMPLETE MODULE OF MULTIDECK SHIP HULL

FIELD OF THE INVENTION

The invention relates to shipbuilding and more particularly to methods for assembling complete modules of multideck ship hulls.

A complete module is a rigid structure assembled from sections of bottom, 'tween decks, upper deck and sides. The breadth of a complete module is equal to that of the ship hull, the height thereof is equal to the hull height, whereas the length of the module depends on the longitudinal division of the ship hull into modules.

The complete modules are then assembled into a middle body of a multideck ship.

DESCRIPTION OF THE PRIOR ART

At the present time known in the art is a method for assembling a module of a multideck ship from sections and blocks, disclosed in Japanese Pat. No. 52-49633, according to which a module is assembled in the following sequence.

First, bottom sections are delivered to the assembly location.

Then, starboard and port sections are installed in succession on both sides and joined to the bottom sections. After which fully outfitted 'tween deck sections are mounted beginning with the last one, and finally an upper deck section is installed.

All the section erection operations are accomplished with the use of cranes.

The sections are joined together with the use of any known technique providing a permanent connection, for example welding.

However, such methods for assembling a complete module with the use of traditional cranes suffer from a poor mechanization of hull assembly operations and require much time for constructing a module as the assembly and outfitting operations should be fulfilled simultaneously.

SUMMARY OF THE INVENTION

The present invention is essentially aimed at providing a method for assembling a complete module which by virtue of changing the sequence of production operations would make it possible to separate the operations pertaining to the outfitting of sections of decks, bottom and sides from the operations pertaining to the assembly of a complete module, thereby reducing the time required for construction of a complete module.

This aim is attained by a method for assembling a complete module of a multideck ship, comprising sections of bottom, 'tween decks, upper deck and sides, whereby the sections are installed in the assembly location and joined together. According to the invention, first the upper deck section is installed in the module assembly location, the it is lifted to a height exceeding the height of the first 'tween deck section, said first 'tween deck section is introduced under the upper deck section and they are joined together. After this the assembled portion of the complete module is lifted to a height exceeding the height of the second 'tween deck, said second tween deck is introduced under the assembled portion of the module and joined thereto. Then following the indicated procedure the remaining 'tween deck sections are installed and joined to the already assembled portion of the module.

This makes it possible to carry out an overall mechanization of assembly of the complete modules and to markedly increase the degree of functional outfitting of hull structures (decks, bottom and sides), as well as to transfer the majority of outfitting work from the assembly location to specialized production bays, thereby separating the hull assembly work from the outfitting work.

It is expedient after assembling all the deck sections to first install a bottom section and join it to the assembled portion of the module; after which to install side sections and join them to the assembled portion of the module, making up a complete module of a multideck ship hull.

This makes it possible to separate the assembly of the module middle portion involving labour-consuming outfitting work from the work for assembly of side sections of an intricate configuration with the subsequent connection thereof into the complete module. Such sequence of assembly is the most expedient from the standpoint of production process considering the adopted scheme of cutting-out the shell plating of the ships featuring intricate hull lines.

Upon assembling all the deck sections it is possible first to install sections of both sides, join them to the assembled portion of the module and then to install a bottom section and also join it to the assembled portion of the module, making up in such a way a complete module of a multideck ship hull.

This method is technologically expedient for assembling complete modules of the hull portion which accommodates an engine room, as it becomes possible to separate the most part of the mechanical and erection work carried out on the bottom section from the assembly of the remaining portion of the complete module, which requires comparatively small amount of labour and to provide maximum convinience possible for joining the bottom section with the engine room equipment already installed therein to the assembled portion of the module.

In assembly of said side sections it is possible first to install one side section and join it to the assembled portion of the module and then to turn the assembled portion about the vertical axis of symmetry, install the other side section and join it to the previously assembled portion of the module, thereby making up a complete module of a multideck ship hull.

This allows floor-mounted construction work units to be used for assembling complete modules, which ensure the high level of the mechanization of hull construction work.

It is possible previously to join the respective portions of both the side sections to every deck.

This is technologically expedient when assembling complete modules of the ships having uniform lines over a considerable length of the parallel middle body with the seams substantially parallel to the base line.

BRIEF DESCRIPTION OF THE DRAWINGS

The invention will now be described, by way of example, with reference to the accompanying drawings in which.

DETAILED DESCRIPTION OF THE INVENTION

Figure 1:
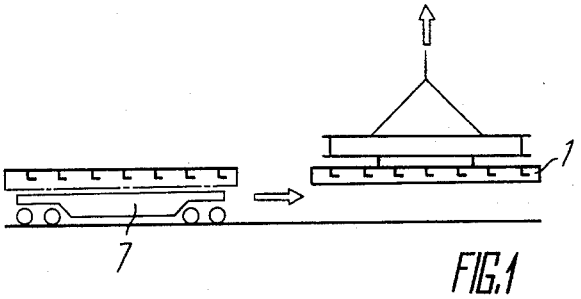
FIGS. 1 to 3 illustrate the sequence of operations when assembling an upper deck and 'tween decks, according to the invention.

A complete module of a multideck ship hull to be assembled comprises sections of an upper deck 1 (FIG. 7), sections of 'tween decks 2 and 3, bottom 4 and sections of a starboard side 5 and port side 6. The number of 'tween decks may be different and depends on the design of the ship hull to be assembled.

To make the understanding simpler, taken here is a module of a hull of a multideck ship having only two 'tween decks 2 and 3.

Prior to delivering the individual sections to the assembly location the sections of all the decks 1, 2 and 3, the bottom 4 and the sides 5 and 6 are outfitted as completely as possible, i.e., they already mount bulkheads, enclosures, machinery and equipment foundations, and the equipment proper unitized to the utmost.

A claimed method for assembling a complete module of a ship hull consists in the following.

First the upper deck section 1 (FIG. 1) is delivered to the assembly location with the help of ground-type transport, such as hauling carriages 7, or any other means, and installed there. Upon delivery the upper deck section 1 is lifted (FIG. 1) to a height exceeding the height of the first 'tween deck section 2 with the equipment installed thereon. For lifting the upper deck section 1 use may be made of any prior art technique, in particular of traditional cranes.

Figure 2:
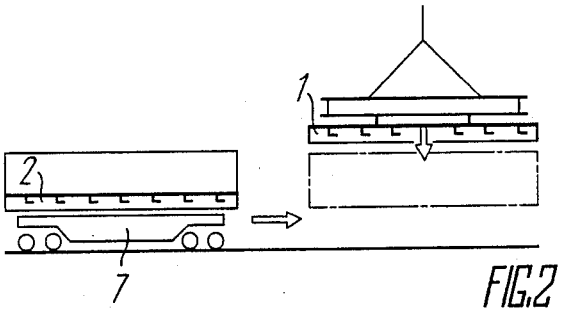
Figure 3:
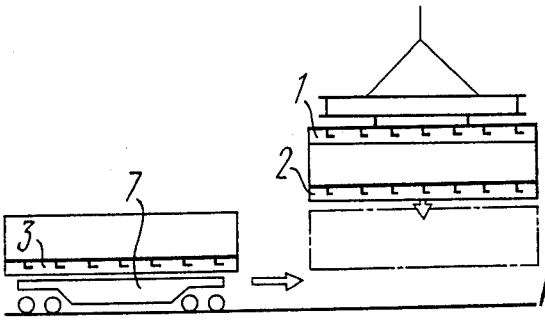

After this the first 'tween deck section 2 (FIG. 2) is delivered to the assembly location and installed under the upper deck section 1, which is lowered down, brought in proper registry with the 'tween deck section 2 and welded thereto. Then, the assembled portion of the module (FIG. 3) is lifted to a height exceeding the height of the second 'tween deck section 3 with the equipment mounted thereon, the second 'tween deck section 3 is supplied to the assembly location, the assembled portion of the module is lowered to be brought in proper registry with the 'tween deck section 3 and welded therewith. The other 'tween decks, if any, are installed and assembled in a similar way.

Figure 4:
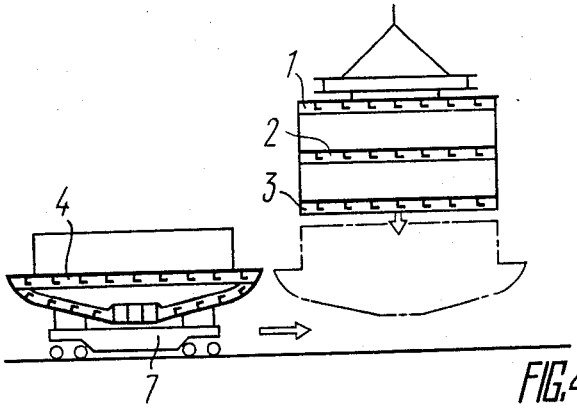
FIGS. 4 to 7 illustrate the sequence of operations when assembling sections of bottom and sides in accordance with an embodiment of the invention.
Figure 5:
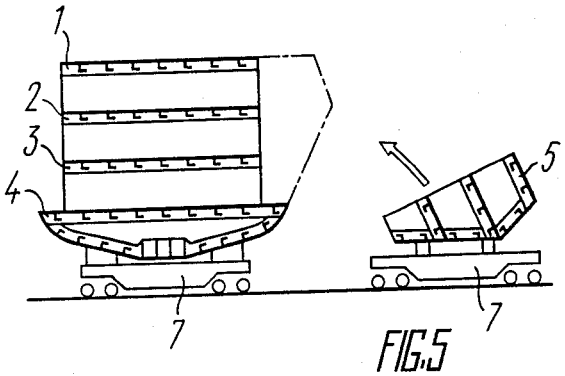
Figure 6:
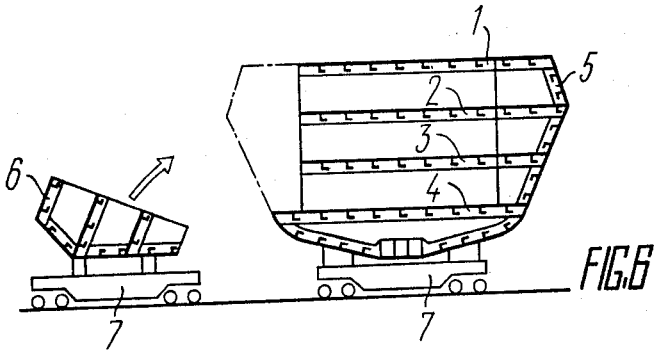
Figure 7:
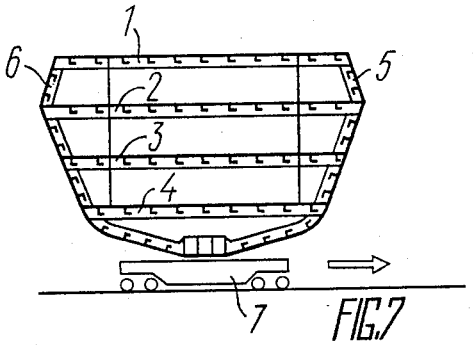

The assembly of all the 'tween decks over, the assembled portion of the module comprising sections 1, 2 and 3 is lifted to a height exceeding the height of the bottom section 4 (FIG. 4) and the bottom section 4 is supplied to the assembly location to be installed under the assembled portion of the module. Then the assembled portion of the module is lowered, brought in proper registry with the bottom section 4 and welded therewith. After this a side section, for example the starboard side section 5 (FIG. 5), is delivered to the welding location and welded with the assembled portion of the module. Then the other side section, the port side section 6. (FIG. 6), is supplied to the assembly location and welded with the assembled portion of the module to make up the complete module of a multideck ship hull (FIG. 7). For bringing the sections 5 and 6 in registry with the assembled portion of the module it is possible to use any prior art technique, including the cranes.

According to another embodiment of the invention the upper deck section 1, 'tween deck sections 2 and 3 are supplied in succession to the assembly location, after which the side sections 5 and 6 are delivered and finally the bottom section 4.

Figure 8:
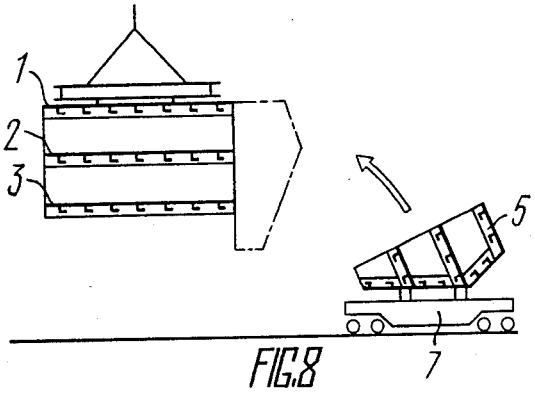
FIGS. 8 to 10 illustrate the sequence of operations when assembling sections of bottom and sides in accordance with another embodiment of the invention.
Figure 9:
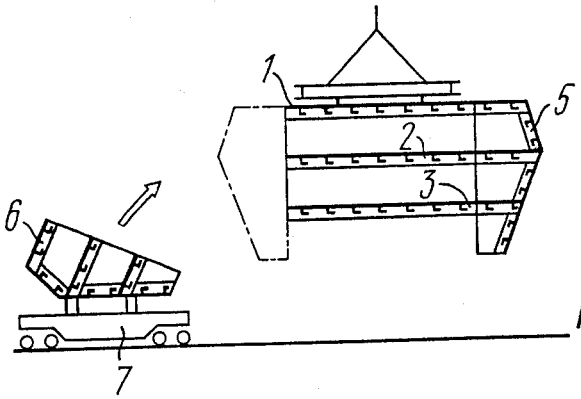
Figure 10:
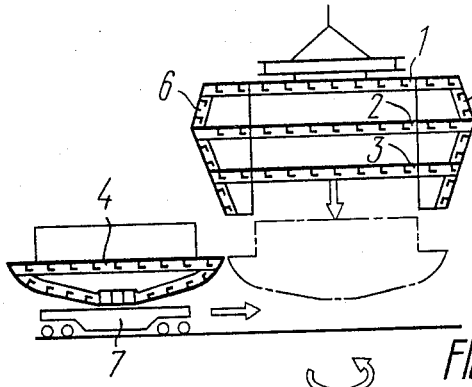

The sections 1 to 3 are assembled as described above (FIGS. 1 to 3). Upon assembly of the sections 1 to 3, first the section of one side, for example the starboard section 5 (FIG. 8), and then of the other side, viz., the port side section 6 (FIG. 9), are joined to the already formed portion of the module. Joining of the sections 5 and 6 to the assembled portion of the module in this case may also be accomplished in any known way and in particular with the use of cranes. After assembling the sections 1 to 3, 5 and 6 the assembled portion of the module in any known way is lifted to a height exceeding the height of the bottom section 4 (FIG. 10) having mounted thereon equipment including main engines. The bottom section 4 is positioned under the assembled portion of the module, the assembled portion is lowered, brought in proper registry with the bottom section 4 and welded therewith, thereby making up the complete module of a multideck ship hull (FIG. 7).

The installation of the side sections 5 and 6 in either of the two embodiments of the invention may also be performed in the following manner.

Figure 11:
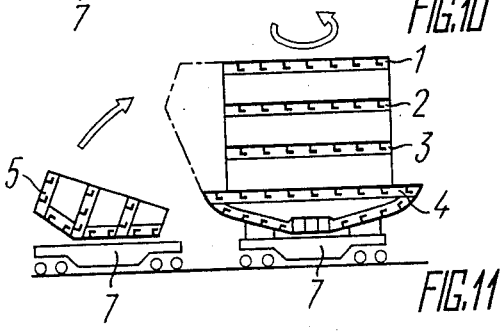
FIGS. 11 and 12 illustrate the sequence of installing side sections, according to the invention.
Figure 12:
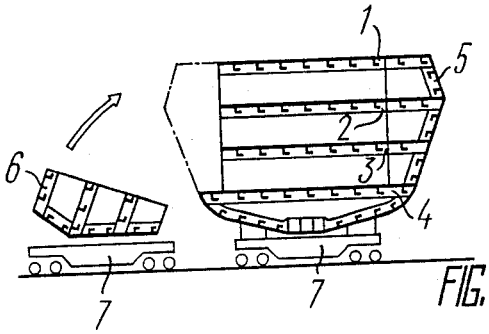

After a side section, for example the starboard side section 5 (FIG. 11), has been installed and welded to the assembled portion of the module, the formed portion of the module is turned about the vertical axis of symmetry in the any known way, for example with the use of a turntable (not shown in drawing). The other side section, viz., port side section 6 (FIG. 12), is delivered to the assembly location and welded to the assembled portion of the module, thereby making up the complete module (FIG. 7). The installation of the sections 5 and 6 in these cases may also be performed in any known way, in particular with the help of a crane.

Figure 13:
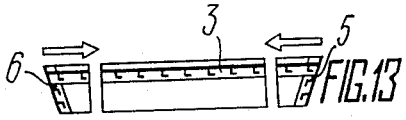
FIG. 13 illustrates the sequence of operations when joining portions of sides to a deck in accordance with still another embodiment of the invention.

In accordance with still another embodiment of the invention, respective portions of the starboard side section 5 and port side section 6 (FIG. 13) may previously be joined to the upper deck section 1 and 'tween deck sections 2 and 3, thereby making up three-dimensional deck sections 1, 2 and 3.

After this the three-dimensional deck section 1 and 'tween deck sections 2 and 3 are supplied in succession to the assembly location followed by the bottom section 4. The sections 1 to 4 are assembled as described above (FIGS. 1 to 4) to make up the complete module of a multideck ship hull (FIG. 7).

It follows from the foregoing that the described sequence of production operations, pertaining to the assembly of the decks of the complete module of a multideck ship, enables one after the final assembly of all the decks either to install the bottom section and then the side sections or first to install the side sections and then the bottom section. Besides, it is possible to install the deck sections with portions of the side sections, thereby making up the decks and both sides simultaneously.

The advantages of the proposed method for assembling complete modules reside in curtailment of the time normally required for the building of modules by virtue of separation of the hull construction work and outfitting work which allows the latter to be done at specialized stations with using the deck structures as assembly floors. In addition, the method according to the invention allows an overall mechanization of the process of delivery and installation of the hull structural elements based on the use of the ground-type hull construction work units.

INDUSTRIAL APPLICABILITY

The claimed method for assembling a module of a ship hull may be used to advantage in assembling multideck ships of various applications.

I claim:

1. A method of assembling a complete module of a multideck ship hull, comprising sections of bottom, 'tween decks, upper deck and sides installed in the assembly location and joined together, wherein the method comprises the steps of installing in the assembly location the upper deck section; lifting the upper deck section to a height exceeding the height of a first 'tween deck; introducing the first 'tween deck under the upper deck section and joining it thereto, thereby creating an assembled portion of said complete module; for each remaining 'tween deck lifting the assembled portion of the complete module to a height exceeding the height of a next 'tween deck, introducing the 'tween deck under the assembled portion of the module and joining it thereto; after installing said upper and 'tween decks introducing and joining said bottom and side sections to said assembled portion to finish said complete module.

2. A method as claimed in claim 1, wherein in joining the bottom and side sections first the bottom section is installed, and joined to the assembled portion of the module, then the side sections are installed and also joined to the assembled portion of the module, thereby making up the complete module of a multideck ship hull.

3. A method as claimed in claim 1, wherein in joining the bottom and side sections, first the side sections are installed and joined to the assembled portion of the module, whereupon the bottom section is installed and joined to the assembled portion of the module, thereby making up the complete module of a multideck ship hull.

4. A method as claimed in claims 2 or 3, wherein in assembling the side sections, a first side section is installed and joined to the assembled portion of the module, then the assembled portion of the module is turned about the vertical axis of symmetry, a second side section is installed and joined to the already assembled portion of the module, thereby making up the complete module of a multideck ship hull.

5. A method of assembly as claimed in claim 1, wherein respective portions of both side sections are previously joined to each of the upper and 'tween decks.

* * * * *